United States Patent [19]

Albertsson

[11] Patent Number: 4,597,524

[45] Date of Patent: Jul. 1, 1986

[54] SNOW MAKING MACHINE

[76] Inventor: Stig L. Albertsson, P.O. Box 297, Manchester, Vt. 05254

[21] Appl. No.: 705,042

[22] Filed: Feb. 25, 1985

Related U.S. Application Data

[63] Continuation of Ser. No. 630,346, Jul. 13, 1984, abandoned, which is a continuation of Ser. No. 360,610, Mar. 22, 1982, abandoned.

[30] Foreign Application Priority Data

Mar. 12, 1983 [EP] European Pat. Off. ..... 83102459.1

[51] Int. Cl.[4] ..... F25C 3/04

[52] U.S. Cl. ..... 239/14

[58] Field of Search ..... 239/2 S, 14

[56] References Cited

U.S. PATENT DOCUMENTS

| | | | |
|---|---|---|---|
| 2,676,471 | 4/1954 | Pierce, Jr. | 239/8 X |
| 2,968,164 | 1/1961 | Hanson | 239/2 S X |
| 3,567,116 | 3/1971 | Lindlof | 239/2 |
| 3,567,117 | 2/1971 | Eustis | 239/2 |
| 3,606,971 | 9/1971 | Harrison et al. | 239/14 |
| 3,610,527 | 10/1971 | Ericson | 239/2 S |
| 3,703,991 | 11/1972 | Eustis et al. | 239/2 S |
| 3,716,190 | 2/1973 | Lindlof | 239/2 S |
| 3,733,029 | 5/1973 | Eustis et al. | 239/14 |
| 3,760,598 | 9/1973 | Jakob et al. | 239/2 X |
| 3,774,842 | 11/1973 | Howell | 239/2 S |
| 3,873,026 | 3/1976 | Ochs | 239/240 |
| 3,923,247 | 12/1975 | White | 239/14 |
| 3,945,567 | 3/1976 | Rambach | 239/14 |
| 4,004,732 | 1/1977 | Hanson | 239/2 S |
| 4,083,492 | 4/1978 | Dewey | 239/2 S |
| 4,105,161 | 8/1978 | Kircher et al. | 239/2 S |
| 4,202,496 | 5/1980 | VanderKelen et al. | 239/14 |
| 4,214,700 | 7/1980 | VanderKelen et al. | 239/2 S |

FOREIGN PATENT DOCUMENTS

| | | |
|---|---|---|
| 4803 | 3/1979 | European Pat. Off. . |
| 7621923 | 7/1976 | France . |
| 7639846 | 12/1976 | France . |

OTHER PUBLICATIONS

Eriksen, Nils, *Ski Area Management,* Jul. 1984, pp. 52–53.

Specification Manual for Stratton Hydrofan, May 1983, pp. 1–6.

*Primary Examiner*—Joseph F. Peters, Jr.
*Assistant Examiner*—David P. Davidson
*Attorney, Agent, or Firm*—Mandeville and Schweitzer

[57] ABSTRACT

The disclosure relates to an improved snow making machine for ski areas and the like, which enables the snow making process to be carried out with greater efficiency than heretofore and with simplifications in the basic equipment requirements. The apparatus utilizes water and compressed air supplies, conventionally provided at the site and extracts a fraction of the energy available in the pressurized water supply by first passing the water through a turbine motor driving an axial fan. The water exiting from the turbine is then mixed with compressed air in a plurality of nozzles and discharged into the air stream created by the turbine-driven axial fan. The equipment makes possible the production of large volumes of high quality snow with greatly reduced requirements for compressed air utilization.

3 Claims, 5 Drawing Figures

FIG. 2
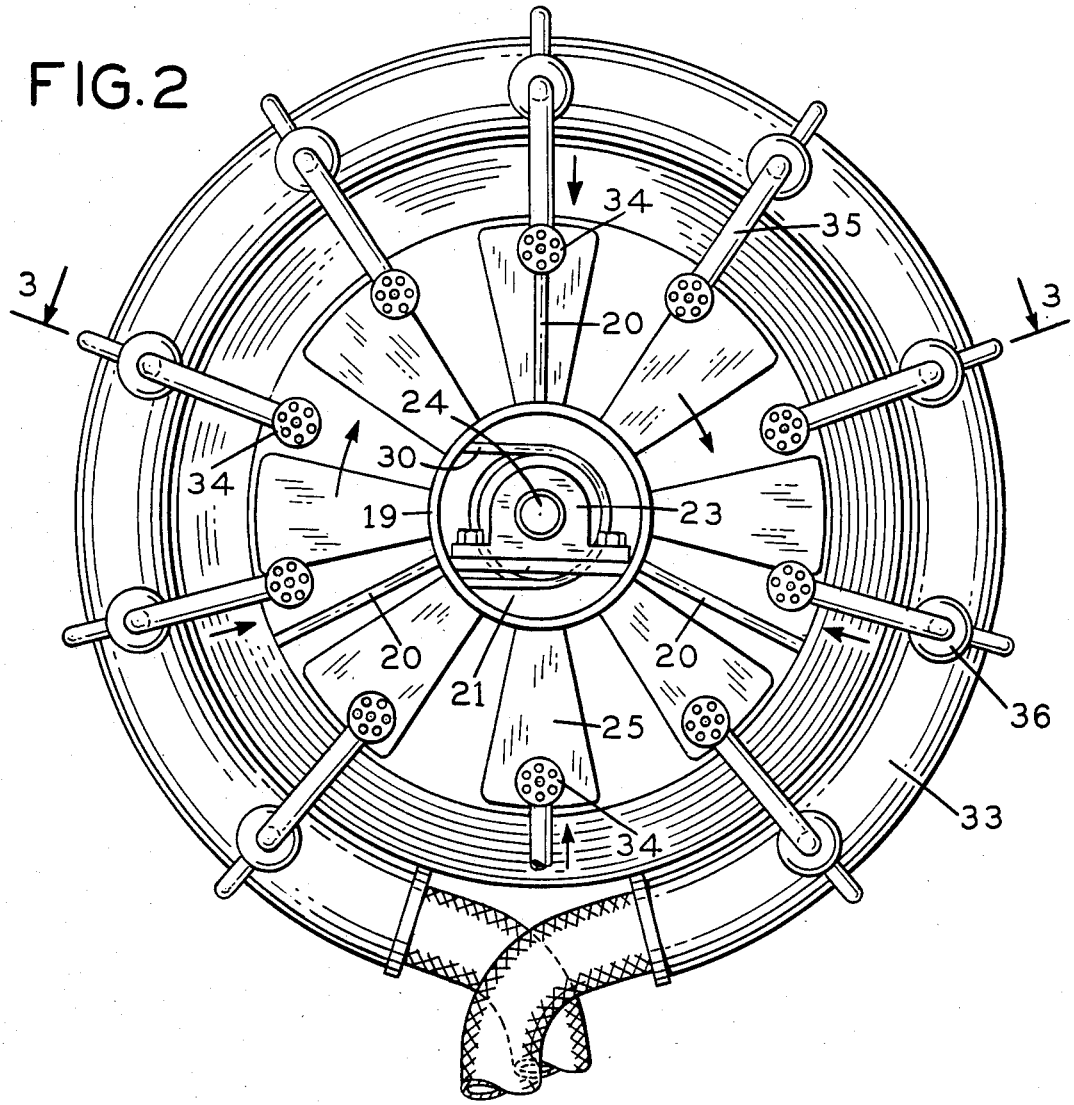
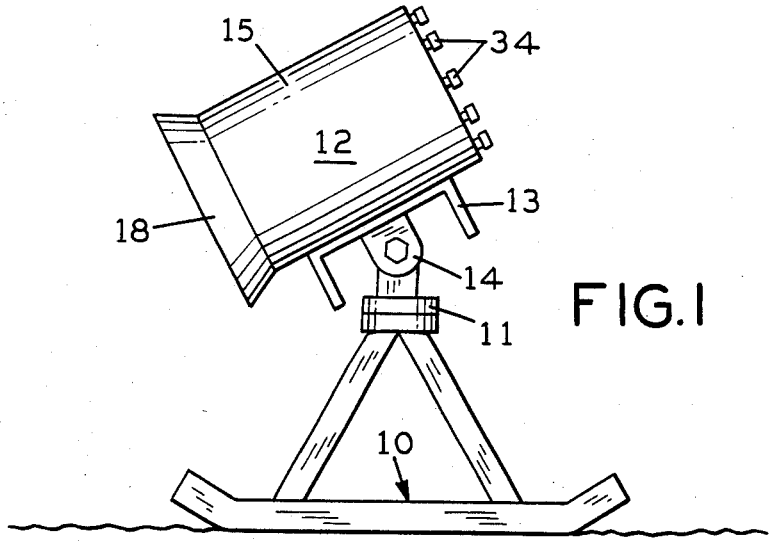
FIG. 1

SNOW MAKING MACHINE

This is a continuation of Ser. No. 630,346, filed 7/13/84, now abandoned which was a continuation of Ser. No. 360,610, filed 3/22/82, now abandoned.

BACKGROUND AND SUMMARY OF THE INVENTION

The manufacture of man-made snow at commercial ski areas is widely practiced, as a means for not only extending the useful season of the ski area, but also improving the quality and uniformity of the surface during the primary season. Typically, in the production of man-made snow, the snow making areas are furnished with supplies of compressed air and water under pressure. Usually, these are in the form of permanent distributional installations, with provisions being made for connection of the snow making equipment at appropriate locations. The Pierce, Jr. U.S. Pat. No. 2,676,471 is representative of such an installation.

One of the common techniques for the production of man-made snow is the mixture and discharge of water and compressed air through a simple discharge gun as, for example, the type shown in the Lindlof U.S. Pat. No. 3,716,190. The water is partially atomized within the gun, when it is mixed with the high pressure compressed air, and the high velocity discharge of the water/compressed air mixture serves to complete the atomization and to convey the atomized water particles them an appropriate distance from the discharge nozzle. Snow making guns of this type are simple and reliable, but suffer a disadvantage in requiring a substantial consumption of compressed air, which is an expensive component of the snow making process.

Another common form of snow making apparatus incorporates an engine driven fan, which directs a stream of air at relatively high velocity through a confining shroud and out over the snow making area. A plurality of atomizing water nozzles are distributed around the periphery of the shroud, discharging streams of atomized water at an angle, forwardly and into the fan-driven air stream. Typically, small amounts of compressed air are injected into the water streams immediately prior to discharge from the atomizing nozzles, to facilitate the atomizing process. This technique either eliminates or greatly minimizes the requirement for a compressed air distribution system over the ski area, but in turn suffers the disadvantage that the equipment is both expensive, and inconvenient to operate. Typically, such equipment incorporates a self-contained internal combustion engine. Thus, each snow making unit requires a substantial capital investment. Moreover, the equipment is large, heavy and difficult to move easily around the snow making site. There is an additional inconvenience of having to provide constant maintenance for the internal combustion engines, as well as constant delivery of fuel, etc. Thus, although snow making equipment provided with engine-driven fans has certain significant advantages, it also has important compensating disadvantages. Illustrative of snow making equipment utilizing self-contained engine-driven fan is the Dewey U.S. Pat. No. 4,083,492.

In an effort to avoid the inconvenience and investment cost of providing internal combustion engines with each snow making unit, some of the commercially available fan-type snow making units have employed electric motors for powering the fan. While this has certain conveniences in comparison to the use of self-contained internal combustion engines, it requires the installation and maintenance of heavy-duty electrical service throughout the ski area, and also presents certain maintenance and safety problems. Accordingly, notwithstanding the apparent advantages, the use of electrically driven fans has not proven to be particularly successful commercially. Illustrative of snow making equipment utilizing electrically driven fans is the Jakob, et al. U.S. Pat. No. 3,760,598, the Hanson U.S. Pat. No. 4,004,732, and the Kircher et al. U.S. Pat. No. 4,105,161.

It has also been proposed heretofore, as for example in the Rambach U.S. Pat. No. 3,945,567, to utilize compressed air from the primary compressed air supply source to supply motive power to a fan-type snow maker. Insofar as the applicant is aware, however, such a technique has never achieved any degree of commercial success, possibly because of limitations imposed on the operation of the system by the use of compressed air as a driving medium. In this respect, the relationship of air to water in the atomizing process, for optimum results, is a variable function of temperature and humidity, particularly temperature. Thus, the utilization of compressed air as a motive source for the fan tends to impose limitations upon the flow of compressed air to the system, requiring that the pressurized water serve as the primary variable on the control of the process. This leads to significant inefficiencies in the overall operation and importantly limits the capacity of the equipment to make snow under marginal conditions.

In accordance with one of the significant aspects of the present invention, a novel and improved high efficiency, fan-type snow making apparatus is provided, which derives motive power for driving the fan from the high pressure water supply, prior to discharging of the water through snow making nozzles. In the apparatus of the invention, the snow making nozzles are of the compressed air-water type, similar in principle to the conventional snow making guns that do not use fans. In this respect, the compressed air is introduced into the water supply upstream of the nozzle discharge, enabling mixing and partial atomization to occur prior to discharge from the nozzle extremity. The atomized mixture is discharged directly into the fan-driven stream of distributional air. The arrangement provides for the making and effective widespread distribution of a high quality snow with outstanding efficiencies in terms of the consumption of high pressure compressed air from the primary source. Of course, there is energy utilization from the water supply, but this is more than offset by significant reductions in the consumption requirements for compressed air, the most expensive component of the snow making process.

In a preferred and advantageous form of the invention, all of the compressed air-water atomizing nozzles are placed directly in the fan-induced air stream, and preferably within the confines of a shroud which surrounds the fan. Accordingly, not only is the atomized air/water mixture discharged directly into the distributional air stream for better atomization and snow particle formation, but the constant bathing of the atomizing nozzles in the distributional air stream serves to keep the nozzles clean and free of ice accumulation, which can otherwise have a deleterious effect on the atomizing efficiency and effectiveness of the nozzles.

For a more complete understanding of the above and other features and advantages of the invention, reference should be made to the following detailed description of a preferred embodiment of the invention and to the accompanying drawing.

DESCRIPTION OF THE DRAWING

FIG. 1 is a simplified, side elevational view of a snow making apparatus of the type incorporating principles of the invention.

FIG. 2 is a front elevational view of the atomizing and discharge unit of the apparatus of FIG. 1.

DESCRIPTION OF A PREFERRED EMBODIMENT

Figure 3:
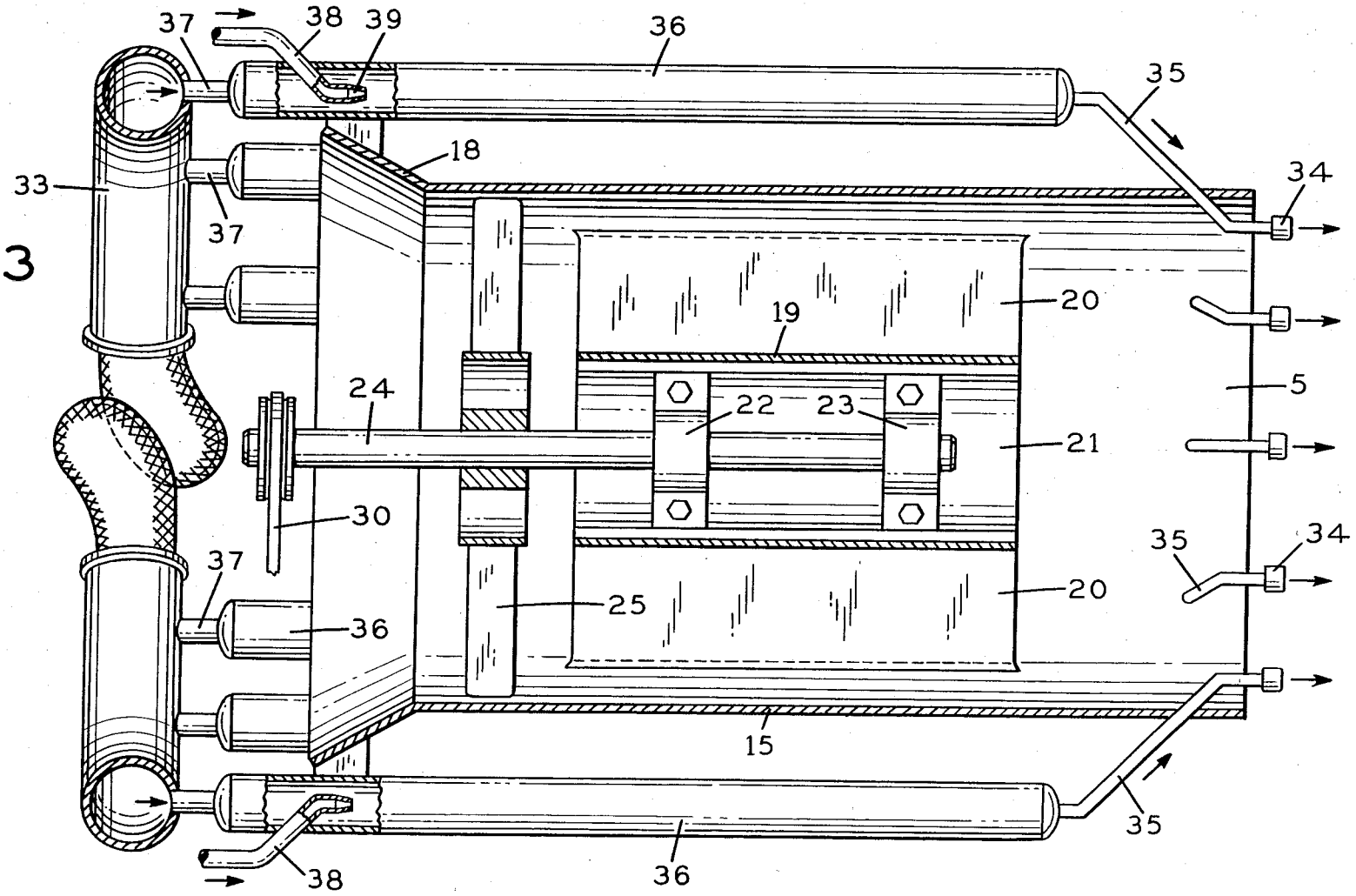
FIG. 3 is a longitudinal sectional view as taken generally on line 3—3 of FIG. 2.
Figure 4:
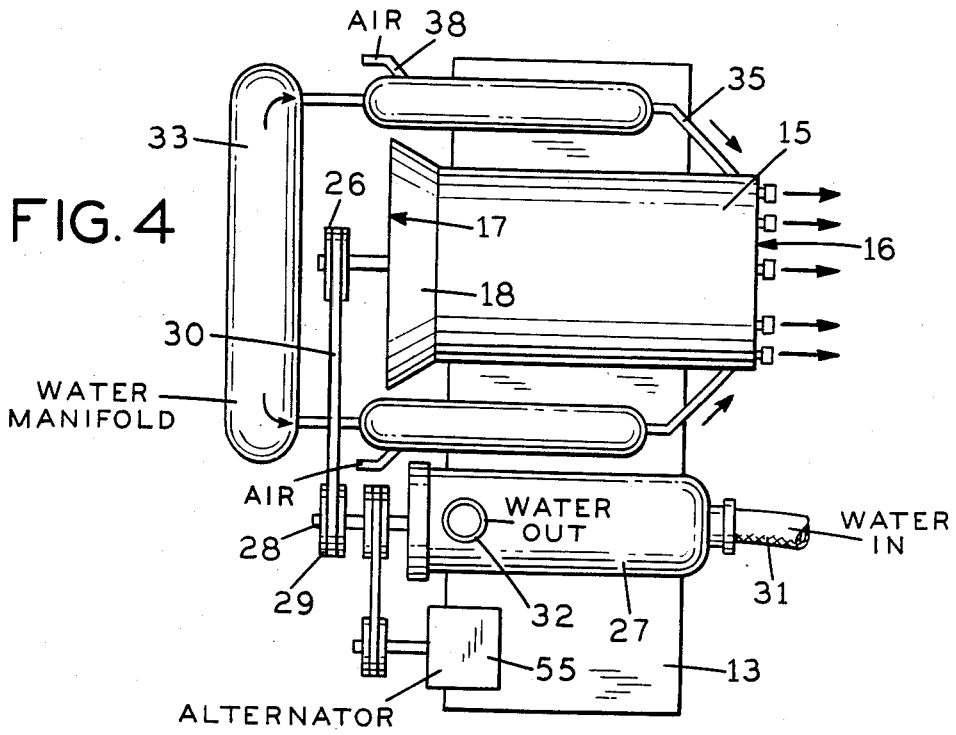
FIG. 4 is a simplified top plan view of the apparatus of FIG. 1.

Referring now to the drawing, the reference numeral 10 designates generally a support structure for the snow making equipment, which typically may be a skid suitable for being towed into position for use, either manually or by the usual snow cat equipment normally available at commercial ski areas. The support structure 10 advantageously may include a swivel arrangement 11, for accommodating rotational movement of the snow generator, generally designated by the numeral 12. A support frame 13 is mounted on the swivel unit 11 and is adapted for adjustable angular positioning by a pivoted support 14, enabling the snow generator to be disposed at a desirable angle to the ground surface.

Mounted on the frame 13 is a generally cylindrical metal shroud 15 having a downstream or discharge end 16 and an upstream or intake end 17. Desirably, the intake end is provided with an outwardly flaired collar 18 to accommodate a relatively efficient flow of air through the shroud.

Internally of the shroud is a support tube 19, which is positioned concentrically within the shroud by means of a plurality of radial fins 20. The support tube 19 has a bearing platform 21 mounted rigidly within, to which are bolted a pair of spaced bearing blocks 22, 23. The bearing blocks journal a shaft 24 which carries, positioned just within the upstream end of the shroud 15 an axial fan 25. In the illustrated structure, the shaft 24 carries at its upstream extremity a pulley 26, which is driven from a turbine motor 27 via the output shaft 28 of the latter, a drive pulley 29 and a flexible belt 30.

In a typical practical embodiment of the invention, the axial fan may be a twelve inch Vaneaxial fan, as manufactured by Hartzell Propeller Fan Co., Piqua, Ohio, designed to move approximately 2400 cmf of air at approximately 3500 rpm, with a power input of approximately one horsepower. This level of power is easily derived from a multistage turbine 27 having a water flow-through of approximately 33 gallons per minute at a pressure drop of approximately 140 psi. In a prototype unit, the turbine 27 was a Gould multistage pump, modified slightly for operation as a turbine motor. Desirably, all of the water flow to the snow generator is supplied through a line 31 leading to the intake of the turbine 27. The discharge outlet 32 of the turbine is connected to a circular manifold 33, mounted at the back of the shroud 15 and connected, in a manner to be described, to a plurality of water atomizing nozzles.

In the illustrated snow generator, there are shown a series of nine (for example) atomizing nozzles 34, arranged in a generally circular array, at the forward end of the shroud 15, advantageously slightly inside the inner wall of the shroud. To this end, discharge lines 35 for the outgoing air/water mixture may pass through the wall of the shroud, near the discharge end thereof. The discharge nozzles may indeed be located totally within the confines of the shroud, or slightly in front of the end thereof, as shown in FIG. 3, for example.

To advantage, the water atomizing arrangements comprise an elongated mixing tube 36 for each discharge nozzle, which may be mounted along the outside of the shroud 15, extending axially forward from the water manifold 33. Each mixing tube is of relatively larger diameter (e.g., 1.5 inches) than the discharge line leading therefrom and is connected at its upstream end to the water manifold 33 through a short delivery tube 37 provided with a restricted orifice. Also entering the upstream end of the mixing tube 36 is an air nozzle 38 carrying compressed air and discharging through a nozzle or orifice 39. Within the mixing tube, there is highly turbulent mixing of the water and compressed air which then exits the mixing tube through the outlet tube 35 leading to the discharge nozzle 34. Typically and desirably, the discharge nozzle 34 is provided with a plurality (e.g., seven) of discharge orifices, from which issue a plurality of streams of air mixed with highly atomized water particles, expelled at relatively high velocity by the compressed air.

Figure 5:
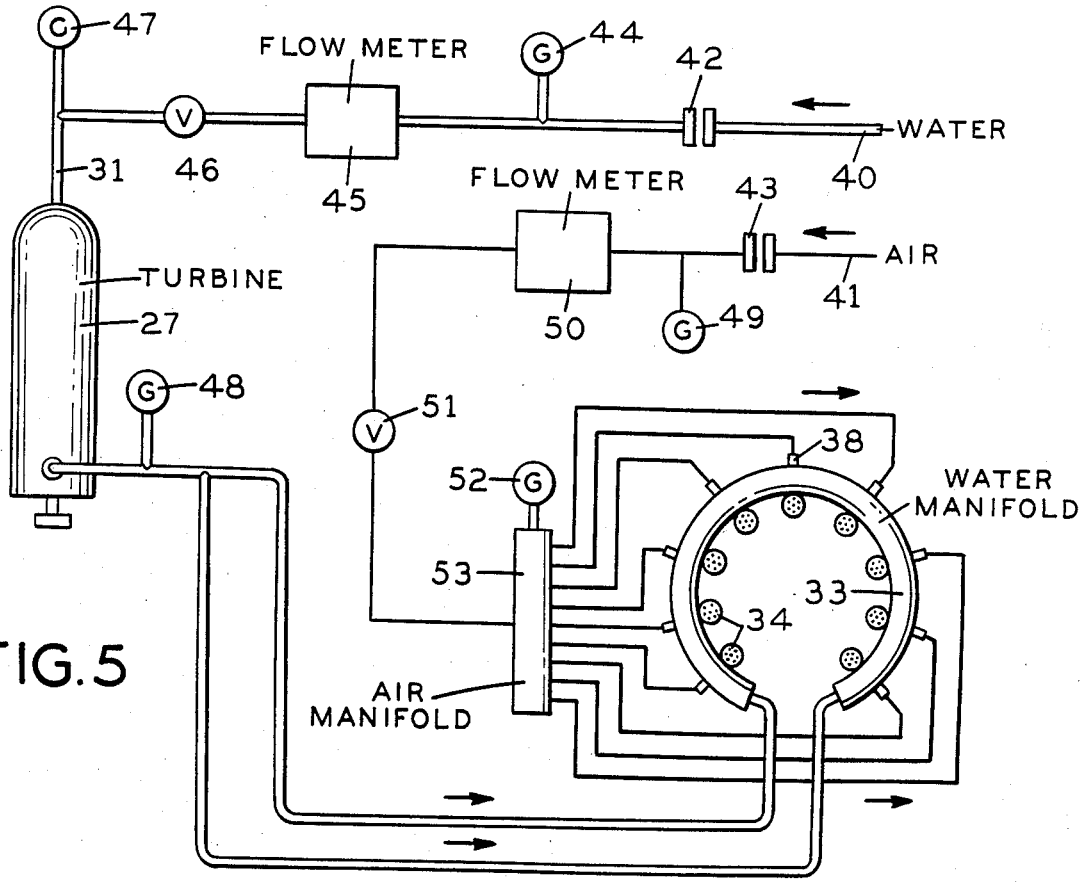
FIG. 5 is a simplified schematic flow diagram of the apparatus of the invention.

In a typical ski area installation with snow making facilities, valved water and air supplies 40, 41 (FIG. 5) are provided adjacent the snow making areas, arranged with quick detachable couplings 42, 43 for connection to the snow making apparatus. In a typical operational system, the water inlet system of the snow maker may include an inlet pressure gauge 44, a flow meter 45, a throttling valve 46, turbine inlet pressure gauge 47 and outlet pressure gauge 48. Downstream of the turbine 27, the water supply divides and enters the manifold 33 from opposite ends, for maximum uniformity of water distribution to the several nozzles. As reflected in the schematic of FIG. 5, all of the incoming water supply is, in the illustrated apparatus, directed through the turbine 27.

The compressed air system of the snow making apparatus includes an incoming pressure gauge 49, flow meter 50, throttling valve 51 and manifold pressure gauge 52 on the downstream side of the throttling valve. The air manifold 53, which may be a circular manifold similar to the water manifold 33, is arranged to distribute the incoming compressed air uniformly to the several air injector nozzles 38.

In typical operation of the described system, approximately 33 gallons per minute of water was delivered to the inlet of the turbine 27 at a pressure on the order of 250 psi. In the prototype unit, approximately 140 psi was dropped through the turbine to drive the fan at around 3200 rpm. The discharge water, at a pressure on the order of 100 psi, was then directed to the water manifold and discharged into the mixing chambers 36, from which the air/atomized water mixture is dischared from the nozzles 34 into the distributional stream of ambient air.

As is well known and recognized, the percentage of compressed air required to be mixed with water in the snow making process is highly variable, as a function of both the temperature and humidity. The higher the temperature and/or relative humidity, the greater proportions of air are required to form ice crystals from the water particles. In all cases, however, the amounts of compressed air per unit of water required with the apparatus of the invention are significantly lower than with conventional air/water atomizing guns under corresponding conditions. For example, under relatively favorable snow making conditions, it is possible with the apparatus of the invention to produce large quantities of quality snow utilizing as little as 90 cfm of air to approximately 33 gallons per minute of water, an extremely favorable ratio. Under extremely unfavorable snow making conditions, approximately 180 cfm of air is used with approximately 33 gallons per minute of water. Compressed air is supplied to the generator at pressures in the range of 85–110 psi.

Desirably, some of the output of the turbine unit 27 may be utilized for other functions, such as driving a small alternator 55. The output of the alternator may be utilized to provide for electrical control functions and/or to effect oscillation of the snow generator for wider distribution of the snow over the area to be covered. In this respect, it is anticipated that a high efficiency turbine unit may readily derive approximately one horsepower via a pressure drop of less than 100 psi at 33 gallons per minute, such that the system can easily accommodate the extraction of minor amounts of energy to serve an alternator 55.

One of the advantageous aspects of the system of the invention is that it enables the production of snow to be maximized under all conditions. In this respect, the flow of water to and its discharge from the snow generator is generally maximized at a constant value, and the primary variable in the process is the amount of air supplied. This, of course, is adjusted to a level as low as the ambient conditions will permit. In general, the volumes of compressed air required to be supplied are significantly less than would have to be supplied to a conventional air/water gun of similar capacity.

Arrangement of the atomizing nozzles directly within the distributional air stream issuing from the fan 25 also serves to increase the overall efficient operation of the system. Because the nozzles are continuously bathed in a relatively high velocity flow of air through the shroud, the nozzles remain clean and free of ice build up, which can otherwise significantly substantially degrade performance of the nozzles.

A rather surprising characteristic of the snow generator of the invention is the fact that it is extremely quiet in operation. Typically, the operation of air/water snow making guns is accompanied by a great deal of penetrating, annoying noise. In the operation of the snow generator of the invention, possibly because of the reduced requirements for compressed air useage, the noise level of the equipment in operation was sufficiently low as to not be disagreeable and annoying even at localtions immediately adjacent to the discharge nozzles.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. Snow making apparatus of the fan-augmented, air/water atomizing type, for use in conjunction with mountain site external supply systems for water and air under pressure, which comprises (a) an open-ended shroud, (b) a fan for directing a flow of air through said shroud, (c) a plurality of air/water atomizing nozzles arranged circumferentially about said shroud and arranged to discharge atomized water and compressed air forwardly along with said flow of air, (d) a water driven tubine driving said fan, (e) means for connecting said inlet of said turbine to said external supply of water under pressure, (f) water delivery means for supplying water to said atomizing nozzles and including said turbine in series, whereby at least a substantial portion of the water delivered to said nozzles is first passed through and serves to drive said turbine and whereby the entire volume of exhaust water from said turbine is directed to snow making nozzles, (g) compressed air delivery means joining said water delivery means upstream of said atomizing nozzles and delivering the compressed air exclusively to said air/water atomizing nozzles, and (h) means for varying the rate of flow of compressed air supplied by said air delivery means relative to the supply of water delivered by said water delivery means.

2. A snow making apparatus of the fan-augmented, air/water type, for use in conjunction with mountain site external supply systems for water and air under pressure, which comprises (a) a fan for generating a flow of relatively high velocity distributional air, (b) a generally cylindrical shroud surrounding said fan, (c) a plurality of air/water atomizing nozzles arranged circumferentially about said fan to discharge atomized water and compressed air in the region of the stream of distributional air and substantially in the direction of movement thereof, (d) a water driven turbine motor for rotating said fan, (e) means for connecting the inlet of said turbine to said external supply of water under pressure, (f) means for directing the entire flow of exhaust water from said turbine motor to said atomizing nozzles for discharge therefrom, (g) compressed air supply means for mixing compressed air with said water prior to discharge from said atomizing nozzles and delivering the compressed air exclusively to said atomizing nozzles, and (h) means to vary the rate of flow of compressed air relative to the flow of said water while maximizing the flow of water.

3. Snow making equipment according to claim 2 further characterized by (a) means for routing all of the water to be ejected by said atomizing nozzles through said turbine motor.

* * * * *